US008141973B2

(12) United States Patent
Hamazaki et al.

(10) Patent No.: US 8,141,973 B2
(45) Date of Patent: Mar. 27, 2012

(54) LIQUID DROPLET EJECTION HEAD AND IMAGE FORMING APPARATUS HAVING THE SAME

(75) Inventors: Toshinobu Hamazaki, Kanagawa (JP); Susumu Hirakata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 985 days.

(21) Appl. No.: 12/121,999

(22) Filed: May 16, 2008

(65) Prior Publication Data

US 2009/0160887 A1 Jun. 25, 2009

(30) Foreign Application Priority Data

Dec. 25, 2007 (JP) ..... 2007-332923

(51) Int. Cl.
*B41J 29/38* (2006.01)
*B41J 2/18* (2006.01)

(52) U.S. Cl. ..... 347/11; 347/89

(58) Field of Classification Search ..... 347/6, 89, 347/11

See application file for complete search history.

(56) References Cited

U.S. PATENT DOCUMENTS

| | | | |
|---|---|---|---|
| 6,095,639 | A | 8/2000 | Uetsuki et al. |
| 2002/0041311 | A1 | 4/2002 | Oishi |
| 2004/0113960 | A1 | 6/2004 | Usui |
| 2006/0197788 | A1 | 9/2006 | Usui |
| 2007/0091150 | A1 | 4/2007 | Kodama |
| 2008/0136860 | A1 | 6/2008 | Kyoso |

FOREIGN PATENT DOCUMENTS

| | | | |
|---|---|---|---|
| CN | 1495019 | | 5/2004 |
| JP | 5-261934 | | 10/1993 |
| JP | 6-155765 | | 6/1994 |
| JP | 9-201960 | | 8/1997 |
| JP | 09-201960 | * | 8/1997 |
| JP | 10-24561 | | 1/1998 |
| JP | 10-100399 | | 4/1998 |
| JP | 2000-327964 | | 11/2000 |
| JP | 2002-234175 | | 8/2002 |
| JP | 2002-248766 | | 9/2002 |
| JP | 2003-011336 | | 1/2003 |
| JP | 2005-193436 | | 7/2005 |
| JP | 2006-116955 | | 5/2006 |
| JP | 2006-159811 | | 6/2006 |
| JP | 2007-118309 | | 5/2007 |
| JP | 2008-142910 | | 6/2008 |

* cited by examiner

*Primary Examiner* — Uyen Chau N Le
*Assistant Examiner* — Kajli Prince
(74) *Attorney, Agent, or Firm* — Fildes & Outland, P.C.

(57) ABSTRACT

A liquid droplet ejection head comprises an ejector, a liquid viscosity-increase prevention structure and a liquid viscosity-increase prevention controller. The ejector includes a nozzle for ejecting a liquid droplet, a pressure chamber communicating with the nozzle through a communication path, and an actuator for applying pressure to a liquid in the pressure chamber. The liquid viscosity-increase prevention structure prevents an increase of viscosity of the liquid in the ejector. The liquid viscosity-increase prevention controller changes the operation frequency of the liquid viscosity-increase prevention structure between when the liquid droplet is ejected from the nozzle and when ejection of the liquid droplet is paused and no liquid droplet is being ejected from the nozzle.

19 Claims, 13 Drawing Sheets

PRELIMINARY WAVEFORM: SMALL

PRELIMINARY WAVEFORM: MEDIUM

PRELIMINARY WAVEFORM: LARGE

FIG. 11A

| | | PRELIMINARY WAVEFORM | | | |
|---|---|---|---|---|---|
| | | NIL | SMALL | MEDIUM | LARGE |
| AMOUNT OF CIRCULATION $\times 10^{-8}$[$m^3$/sec] | 0.0 | 0.04[S] | 0.2 | 100 | 1000 |
| | 0.5 | 0.2 | 1 | 400 | >1000 |
| | 1.0 | 1 | 4 | 1000 | >1000 |
| | 2.0 | 4 | 20 | >1000 | >1000 |
| | 5.0 | 10 | 100 | >1000 | >1000 |
| | 10.0 | 20 | 1000 | >1000 | >1000 |

FIG. 11B

| | | PRELIMINARY WAVEFORM | | | |
|---|---|---|---|---|---|
| | | NIL | SMALL | MEDIUM | LARGE |
| AMOUNT OF CIRCULATION $\times 10^{-8}$[$m^3$/sec] | 0.0 | G | G | G | B |
| | 0.5 | G | G | G | B |
| | 1.0 | G | G | B | B |
| | 2.0 | G | G | B | B |
| | 5.0 | G | G | B | B |
| | 10.0 | G | B | B | B |

FIG. 13

| | | PRELIMINARY WAVEFORM | | | |
|---|---|---|---|---|---|
| | | NIL | SMALL | MEDIUM | LARGE |
| AMOUNT OF CIRCULATION $\times 10^{-8}$ [$m^3$/sec] | 0.0 | 200 | 200 | 200 | 200 |
| | 0.5 | 200 | 200 | 200 | 200 |
| | 1.0 | 200 | 200 | 200 | 150 |
| | 2.0 | 200 | 150 | 150 | 100 |
| | 5.0 | 150 | 100 | 100 | 50 |
| | 10.0 | 100 | 100 | 50 | 20 |

LIQUID DROPLET EJECTION HEAD AND IMAGE FORMING APPARATUS HAVING THE SAME

CROSS-REFERENCE TO RELATED APPLICATION

This application is based on and claims priority under 35 USC 119 from Japanese Patent Application No. 2007-332923 filed Dec. 25, 2007.

BACKGROUND

1. Technical Field

The present invention relates to a liquid droplet ejection head for ejecting a liquid droplet and an image forming apparatus having the liquid droplet ejection head.

2. Related Art

There is known an image forming apparatus for ejecting a liquid droplet from a nozzle in a state that a liquid is circulated in an ejector to prevent the increase of viscosity of a liquid in the vicinity of the nozzle In more detail, when ejection of a liquid droplet is paused and no liquid droplet is being rejected from a nozzle, a liquid is also circulated in the same amount as that of the liquid circulating in an ejector when a liquid droplet is ejected from the nozzle. With this operation, the increase of viscosity of the liquid in the vicinity of the nozzle can be prevented.

Further, there is also an image forming apparatus in which a liquid droplet is ejected from a nozzle at every predetermined time regardless of image formation (preliminary ejection) to prevent the increase of viscosity of a liquid in the vicinity of a nozzle However, when the preliminary ejection is performed, a liquid is wastefully used (waste liquid) in no relation to image formation. To cope with the above problem, the intervals of the preliminary ejection can be increased by circulating a liquid in an ejector, thereby the amount of the waste liquid can be reduced. However, recently, it is desired to reduce the amount of the waste liquid more than ever to increase the added value of an image forming apparatus.

SUMMARY

The present invention, which was made in consideration of the above fact, is provided to suppress the increase of viscosity of a liquid in the vicinity of a nozzle as well as to reduce the amount of a waste liquid caused by a preliminary ejection.

According to a first exemplary embodiment of the present invention, there is provided a liquid droplet ejection head comprising: an ejector including a nozzle for ejecting a liquid droplet, a pressure chamber communicating with the nozzle through a communication path, and an actuator for applying pressure to a liquid in the pressure chamber; a liquid viscosity-increase prevention structure for preventing an increase of viscosity of the liquid in the ejector; and a liquid viscosity-increase prevention controller for changing the operation frequency of the liquid viscosity-increase prevention structure between when the liquid droplet is ejected from the nozzle and when ejection of the liquid droplet is paused and no liquid droplet is being ejected from the nozzle.

According to a second exemplary embodiment of the present invention, there is provided a liquid droplet ejection head comprising: an ejector including a nozzle for ejecting a liquid droplet, a pressure chamber communicating with the nozzle through a communication path, and an actuator for applying pressure to a liquid in the pressure chamber; a cap member for preventing evaporation of a liquid by capping the nozzle; a liquid viscosity-increase prevention structure for preventing an increase of viscosity of the liquid in the ejector; and a liquid viscosity-increase prevention controller for operating the liquid viscosity-increase prevention structure before the nozzle is uncapped from the cap member and ejects a liquid droplet.

According to a third exemplary embodiment of the present invention, there is provided an image forming apparatus having a liquid droplet ejection head, the liquid droplet ejection head comprising: an ejector including a nozzle for ejecting a liquid droplet, a pressure chamber communicating with the nozzle through a communication path, and an actuator for applying pressure to a liquid in the pressure chamber; a liquid viscosity-increase prevention structure for preventing an increase of viscosity of the liquid in the ejector; and a liquid viscosity-increase prevention controller for changing the operation frequency of the liquid viscosity-increase prevention structure when the liquid droplet is ejected from the nozzle, and when ejection of the liquid droplet is paused and no liquid droplet is being ejected from the nozzle.

According to a fourth exemplary embodiment of the present invention, there is provided an image forming apparatus having a liquid droplet ejection head, the liquid droplet ejection head comprises: an ejector including a nozzle for ejecting a liquid droplet, a pressure chamber communicating with the nozzle through a communication path, and an actuator for applying pressure to a liquid in the pressure chamber; a cap member for preventing evaporation of a liquid by capping the nozzle; a liquid viscosity-increase prevention structure for preventing an increase of viscosity of the liquid in the ejector; and a liquid viscosity-increase prevention controller for operating the liquid viscosity-increase prevention structure before the nozzle is uncapped from the cap member and ejects a liquid droplet.

BRIEF DESCRIPTION OF THE DRAWINGS

Exemplary Embodiments of the present invention will be described in detail based on the following figures, wherein:

FIG. 11A is a table showing the relation among the preliminary waveform, the ink amount of circulation, a maintaining time of the liquid droplet speed, and the like for confirming the effect of the liquid droplet ejection head according to the first exemplary embodiment of the invention;

FIG. 11B is a table showing the relation among the preliminary waveform, the ink amount of circulation, an ejection stability, and the like for confirming the effect of the liquid droplet ejection head according to the first exemplary embodiment of the invention;

FIG. 13 is a table showing a preliminary waveform, an ink amount of circulation, and the number of times of a preliminary ejection for confirming the effect of the liquid droplet ejection head according to the second exemplary embodiment of the invention.

DETAILED DESCRIPTION

An image forming apparatus, in which a liquid droplet ejection heads according to a first exemplary embodiment of the present invention is employed, will be explained using FIGS. 1 to 11.

(Overall Arrangement)

Figure 5:
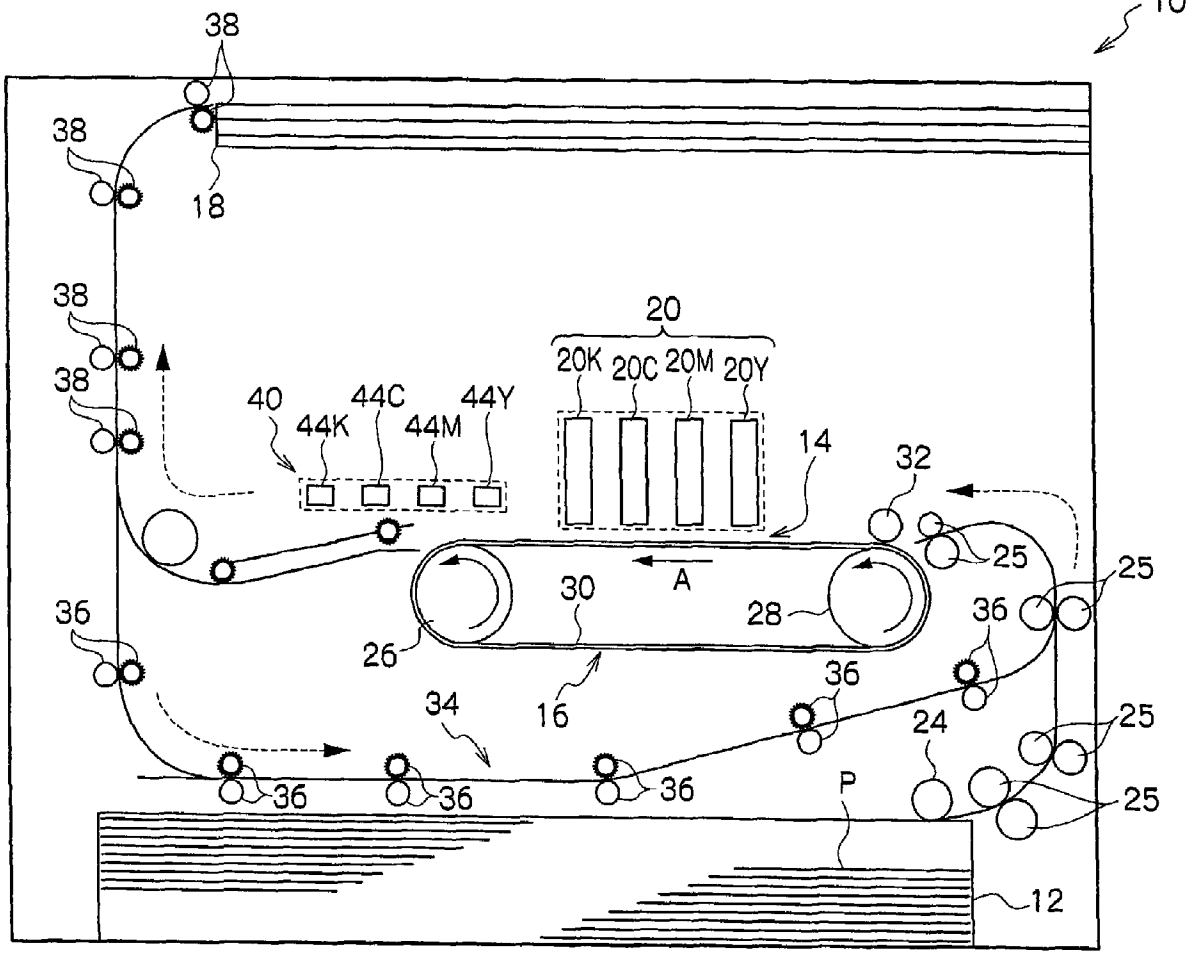
FIG. 5 is a schematic arrangement view of the inkjet recording apparatus to which the liquid droplet ejection head according to the first exemplary embodiment of the invention is employed.

As shown in FIG. 5, an inkjet recording apparatus 10 as an example of the image forming apparatus according to the invention includes a sheet feeding unit 12 in which sheet materials P as recording media are accommodated, an image recording unit 14 for recording an image to a sheet material P supplied from the sheet feeding unit 12, a transport means 16 for transporting the sheet material P to the image recording unit 14, and a sheet discharge unit 18 for accommodating the sheet material P to which the image is recorded by the image recording unit 14.

The image recording unit 14 has a liquid droplet ejection head 20. The liquid droplet ejection head 20 includes a nozzle surface 96 to which a multiplicity of nozzles 42 (refer to FIG. 2) are formed to eject liquid droplets. Further, the liquid droplet ejection head 20 is disposed to extend in a direction intersecting (orthogonal to) a transport direction in which the sheet material P is transported and has a record possible region as large as or larger than the maximum width of the sheet material P.

Further, the liquid droplet ejection heads 20 are disposed in parallel in the sequence of yellow (Y), magenta (M), cyan (C), and black (K) at the same intervals from the upstream of the transport direction of the sheet material P and eject liquid droplets by a known means such as a thermal system, a piezoelectric system. Note that, various types of inks such as water-based ink, oil-based ink, solvent ink, and the like can be used as the ink of the liquid droplet ejection head 20. Note that the detail of the liquid droplet ejection head 20 will be described later.

Further, the liquid droplet ejection heads 20Y, 20M, 20C, and 20K are provided with a maintenance unit 40 as a recovery unit. The maintenance unit 40 can be moved by a moving means such as a rack and pinion, and the like (not shown) to a pausing position when an image is formed (refer to FIG. 5) and to an executing position (refer to FIG. 4) at which the liquid droplet ejection head 20Y, 20M, 20C, and 20K are subjected to maintenance.

The maintenance unit 40 includes cap members 44Y, 44M, 44C and 44K acting as a cap member for preventing evaporation of inks by capping the nozzles 42.

Figure 4:
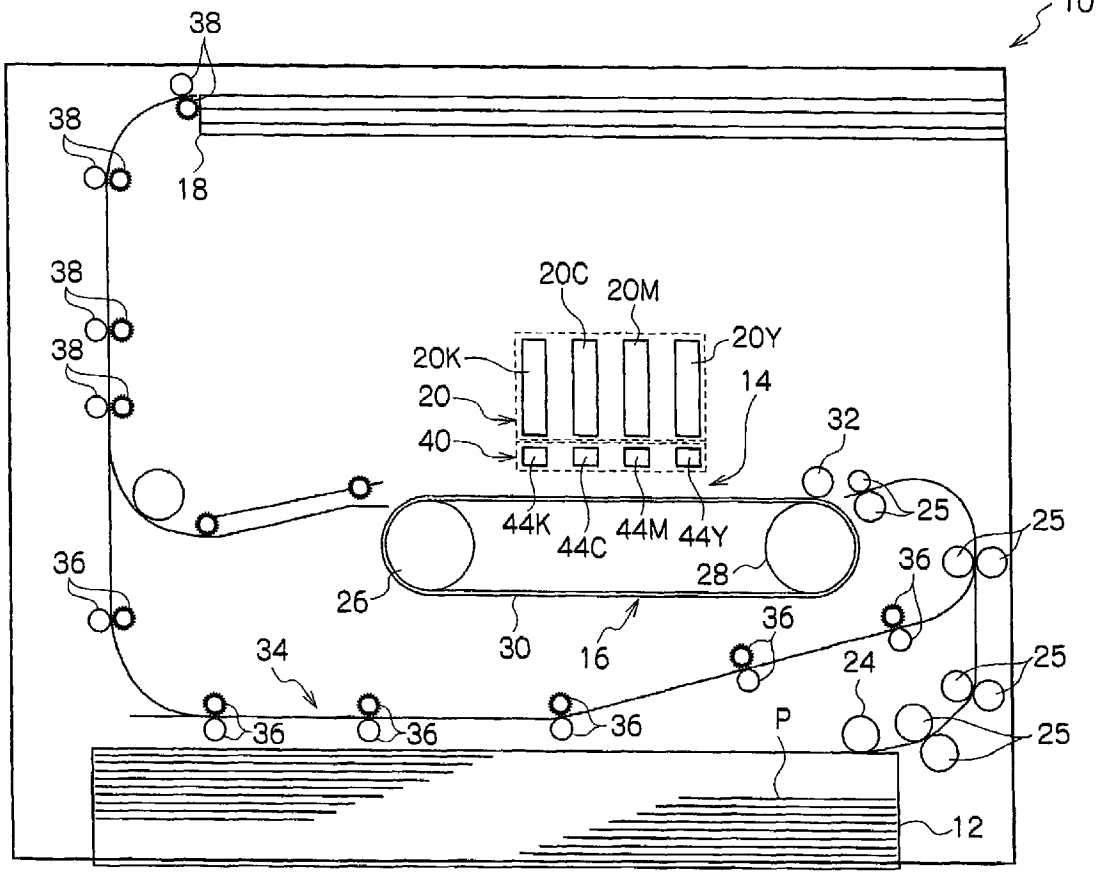
FIG. 4 is a schematic arrangement view of an inkjet recording apparatus to which the liquid droplet ejection head according to the first exemplary embodiment of the invention is employed.

When the liquid droplet ejection heads 20Y to 20K are inactive for a long time, the liquid droplet ejection heads are integrally lifted together to a predetermined height, the maintenance unit 40 moves in a direction opposite to the transport direction of the sheet material P, and the cap members 44 are disposed in opposition to the nozzle surfaces 96 of the liquid droplet ejection heads 20 as shown in FIG. 4. As described above, the liquid droplet ejection head 20 can move in an up/down direction so that it can be subjected to a restoration operation and the like.

In contrast, as shown in FIG. 5, the sheet materials P in the sheet feeding unit 12 are taken out one by one by a pick-up roller 24 and fed to the image recording unit 14 by transport rollers 25. The transport means 16 disposed to the inkjet recording apparatus 10 has a transport belt 30 for causing the print surface of the sheet material P to face the liquid droplet ejection head 20. The transport belt 30 is stretched between a drive roller 26 disposed downstream of the sheet transport direction and a driven roller 28 disposed upstream of the sheet transport directions and driven in circulation (rotated) in the direction of an arrow A shown in FIG. 5.

Further, an electrostatic charging roller 32 is disposed above the driven roller 28 so that it is driven by the transport belt 30 from the front surface side thereof. Since the transport belt 30 is electrostatically charged by the electrostatic charging roller 32 (charge is applied), the sheet material P is electrostatically adsorbed to the transport belt 30 and transported thereby. Note that the transport belt 30 is not limited to the arrangement in which it holds the sheet material P by electrostatically adsorbing it. And it may hold the sheet material P by the friction therebetween or hold the sheet material P by a non-electrostatic means such as absorption, adhesion.

Further, an inverting unit 34 is disposed below the transport belt 30, and when a duplex print is performed, the sheet material P is transported by a plurality of feed rollers 36 and supplied to the image recording unit 14 again. A plurality of transport rollers 38 is also disposed at the predetermined positions of a transport path to the sheet discharge unit 18. Although not shown, the inkjet recording apparatus 10 has a control means of the liquid droplet ejection head 20 and a system control means. The control means of the liquid droplet ejection head 20 determines a timing at which a liquid droplet is ejected and a nozzle to be used in response to an image signal and applies a drive signal to the nozzle, and the system control means controls the inkjet recording apparatus 10 in its entirety.

Next, the maintenance unit 40 will be explained.

Figure 1:
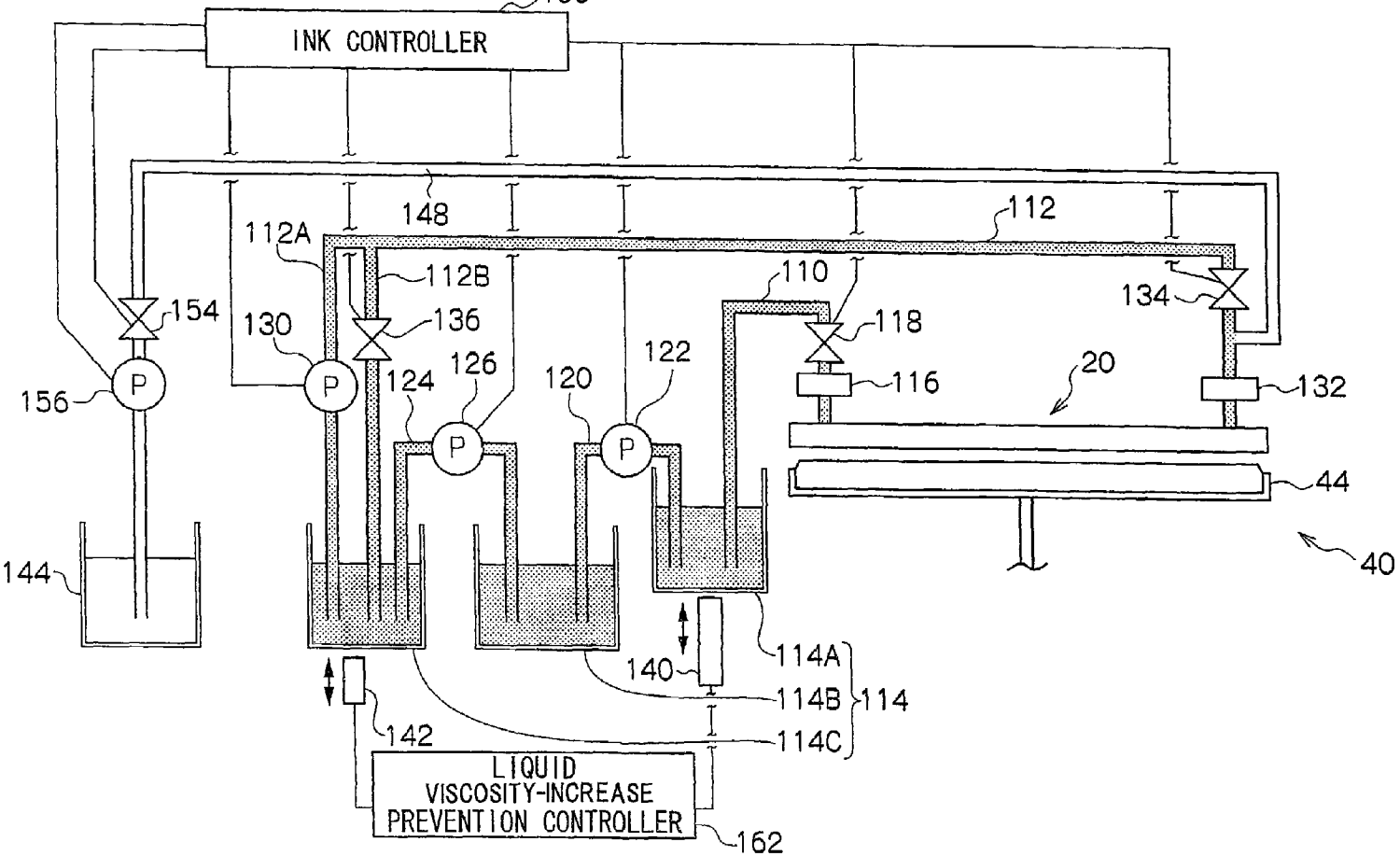
FIG. 1 is a schematic arrangement view showing a liquid droplet ejection head, ink tanks, and the like according to a first exemplary embodiment of the invention.

As shown in FIG. 1, the liquid droplet ejection head 20 includes the multiplicity of nozzles 42 (refer to FIG. 2) and extends to the direction intersecting the transport direction of the sheet material P, and the cap members 44 are disposed as many as the liquid droplet ejection heads 20 for respective colors. Each of the cap members 44 covers (caps) the nozzle surface 96 (the nozzles 42) of each of the liquid droplet ejection heads 20 so that it prevents the ink in the nozzles 42 from being dried and protects the nozzle surfaces 96. That is, when the respective cap 44 is disposed in opposition to the nozzle surfaces 96 of the respective liquid droplet ejection head 20, the respective cap members 44Y, 44M, 44C, and 44K are lifted upward and come into intimate contact with the respective nozzle surfaces 96.

Further, a box-shaped ink receiver (not shown) having an open upper is disposed. When the nozzle surfaces 96 are separated from the cap members 44, the ink receiver moves to positions in opposition to the nozzle surfaces 96 so that it receives waste ink such as ink ejected by preliminary ejection (ink that is not used for image formation).

(Arrangement of Main Portion)

Next, the liquid droplet ejection head 20 will be explained.

Figure 3:
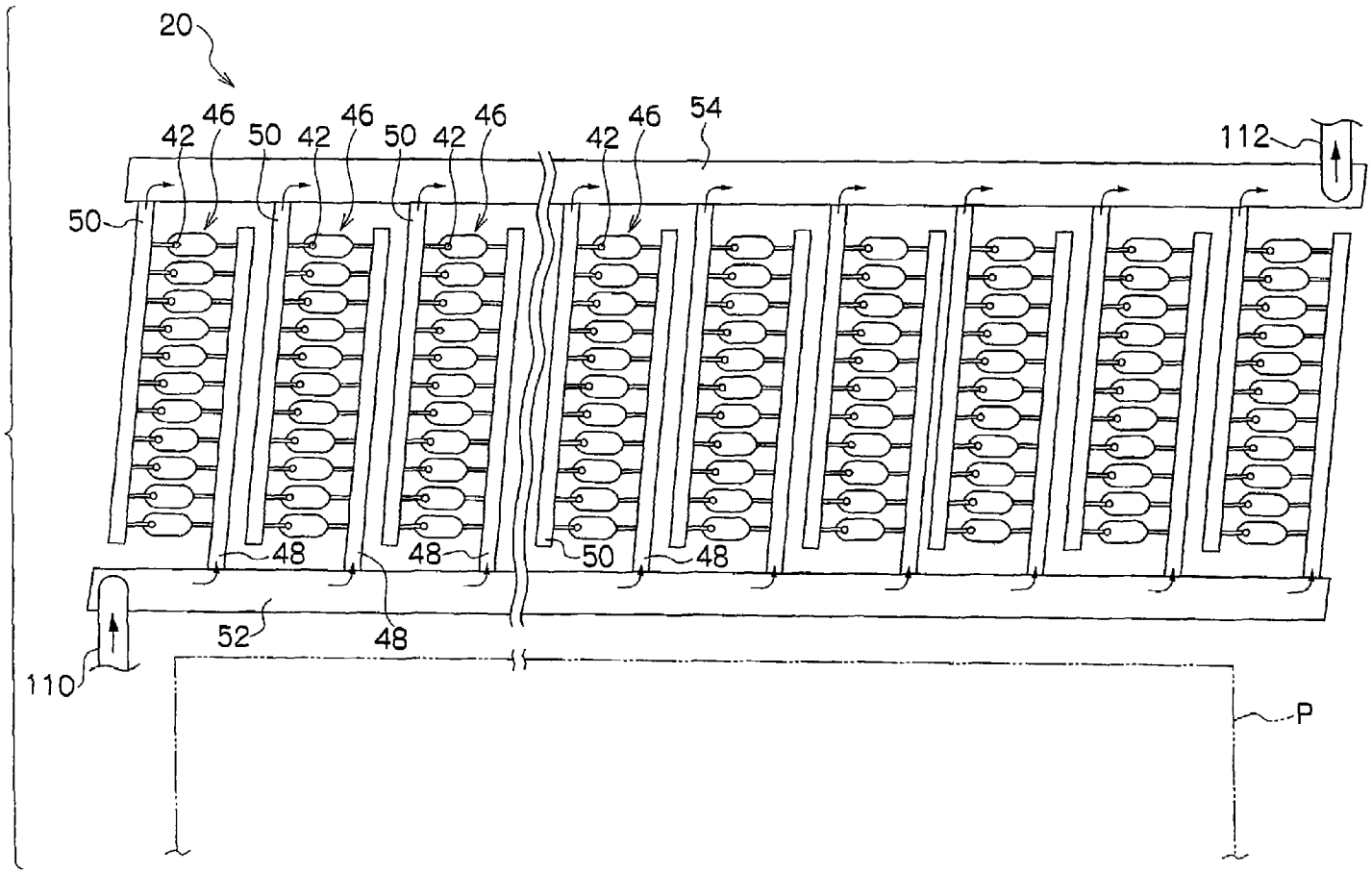
FIG. 3 is a plan view showing the liquid droplet ejection head according to the first exemplary embodiment of the invention.

As shown in FIG. 3, a plurality of columns of the ejectors 46 each having the nozzle 42 for ejecting a liquid droplet are disposed to the liquid droplet ejection head 20 in a longitudinal direction (up/down direction shown in FIG. 3). A first branch flow path 48 is formed adjacent to the ejectors 46 of each column and extends in the column direction to supply ink to the respective ejectors 46. Further, a second branch flow path 50 is formed on the opposite side of the first branch flow path 48 across the ejectors 46 of each column so that the ink discharged from the ejectors 46 flows into the second branch flow path 50.

Further, a first main flow path 52 is formed to an end (lower end shown in FIG. 3) of each first branch flow path 48 and extends to a direction intersecting the longitudinal direction of the first branch flow path 48 to supply the ink to each first branch flow path 48. Note that a first fluid flow path 51 is composed of the first main flow path 52 and the first branch flow paths 48.

Further, a second main flow path 54 is formed to an end (upper end shown in FIG. 3) of each second branch flow path 50 and extends to a direction intersecting the longitudinal direction of the second branch flow path 50 so that the ink discharged through each second branch flow path 50 flows into the second main flow path 54. Note that a second fluid flow path 53 is composed of the second main flow path 54 and the second branch flow paths 50.

Figure 2:
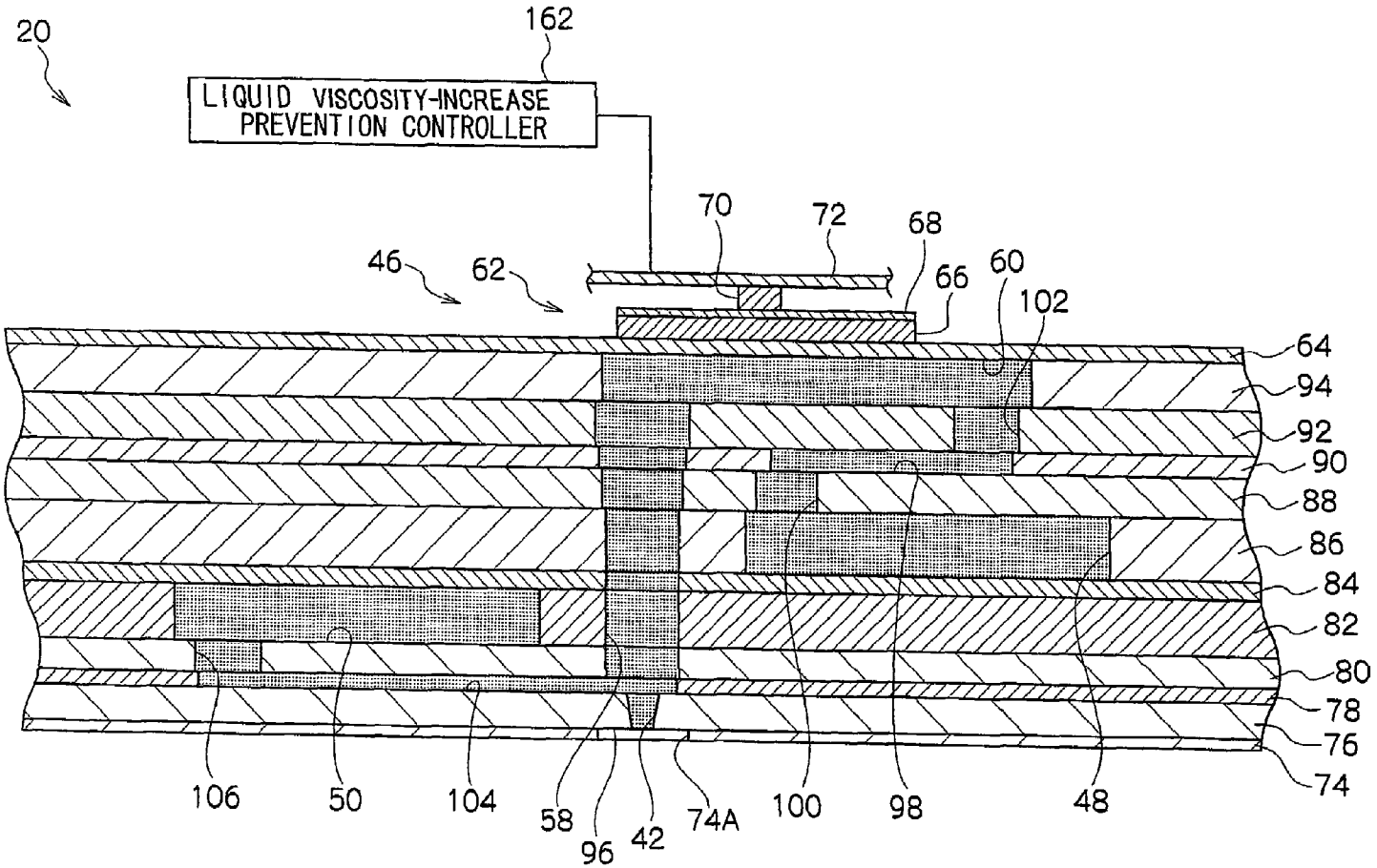
FIG. 2 is a sectional view showing the liquid droplet ejection head according to the first exemplary embodiment of the invention.

As shown in FIG. 2, each ejector 46 includes the nozzle 42, a pressure chamber 60, and an actuator 62. The nozzle 42 ejects a liquid droplet, the pressure chamber 60 communicates with the nozzle 42 through a communication path 58 as well as stores the ink, and the actuator 62 applies pressure to the ink in the pressure chamber 60. Further, the actuator 62 includes a sheet-shaped diaphragm 64 and a drive element 66. A circuit substrate 72 is disposed to an upper electrode 68 of the drive element 66 through a solder bump 70. Note that a liquid viscosity-increase prevention controller 162 is connected to the circuit substrate 72 and controls a preliminary waveform applied to the actuator 62 through the circuit substrate 72.

Each first branch flow path 48 is interposed between the columns of the ejectors 46 as well as a part of the first branch flow path 48 is disposed so as to overlap the ejectors 46 when viewed from the nozzle surface 96.

Each second branch flow path 50 is interposed between the columns of the ejectors 46 and communicates with the respective ejectors 46, and the ink discharged from the respective ejectors 46 is supplied to the second main flow path 54 (refer to FIG. 3) through the second branch flow path 50.

Further, the liquid droplet ejection head 20 according to the exemplary embodiment includes a recessed portion forming plate 74, a nozzle plate 76, a discharge path forming plate 78, a discharge hole forming plate 80, a branch flow path forming plate 82, a resin plate 84, a branch flow path forming plate 86, a first supply hole forming plate 88, a supply path forming plate 90, a second supply hole forming plate 92, a pressure chamber forming plate 94, the diaphragm 64, and the drive element 66.

The recessed portion forming plate 74, the nozzle plate 76, the discharge path forming plate 78, the discharge hole forming plate 80, the branch flow path forming plate 82, the resin plate 84, the branch flow path forming plate 86, the first supply hole forming plate 88, the supply path forming plate 90, the second supply hole forming plate 92, the pressure chamber forming plate 94, the diaphragm 64, and the drive element 66 are laminated in this order.

The nozzle 42 is formed to the nozzle plate 76 to eject liquid droplets. A recessed portion 74A is formed to the recessed portion forming plate 74 in the periphery of the nozzle 42. The recessed portion 74A is a step formed to the periphery of the nozzle 42. The portion where the nozzle 42 is formed is recessed from a plate surface by the step to prevent, for example, the periphery of the nozzle 42 from being subjected to friction by coming into contact with the sheet material P and to prevent the periphery of the nozzle from being subjected to mechanical friction when the nozzle surfaces 96 are wiped.

Further, the pressure chamber 60 is formed to the pressure chamber forming plate 94 so as to communicate with the nozzle 42 as well as to store the ink. The pressure chamber 60 communicates with the nozzle 42 through the communication path 58 formed to the discharge path forming plate 78, the discharge hole forming plate 80, the branch flow path forming plate 82, the resin plate 84, the branch flow path forming plate 86, the first supply hole forming plate 88, the supply path forming plate 90, and the second supply hole forming plate 92 so that the ink can flow from the pressure chamber 60 to the nozzle 42.

The first branch flow paths 48 are formed to the branch flow path forming plate 86, and a supply path 98 is formed to the supply path forming plate 90 to supply the ink from the first branch flow paths 48 to each pressure chamber 60.

The supply path 98 communicates with the first branch flow paths 48 through a first supply hole 100 formed to the first supply hole forming plate 88. Further, the supply path 98 communicates with the pressure chamber 60 through a second supply hole 102 formed to the second supply hole forming plate 92.

A discharge path 104 is formed to the discharge path forming plate 78 laminated just on the nozzle plate 76 to communicate with the communication path 58. The discharge path 104 communicates with the second branch flow path 50 through a discharge hole 106 formed to the discharge hole forming plate 80.

With this arrangement, the ink, which flows from the first branch flow path 48 into the ejector 46, flows into the pressure chamber 60 through the first supply hole 100, the supply path 98, and the second supply hole 102. The ink, which flows into the pressure chamber 60, flows above the nozzle 42 passing through the communication path 58 and is discharged into the second branch flow path 50 flowing through the discharge path 104 and the discharge hole 106.

As shown in FIG. 3, one end of a flow path pipe 110, which supplies the ink to the first main flow path 52, is connected to one end (left end of FIG. 3) of the first main flow path 52, and one end of a flow path pipe 112, into which the ink discharged to the second main flow path 54, is connected to the end (right end of FIG. 3) of the second main flow path 54.

As shown in FIG. 1, a filter 116 is disposed to the flow path pipe 110 to filtrate the ink, and further open/close valves 118 which are capable of open/close, are sequentially disposed from the liquid droplet ejection head 20 side. The other end of the flow path pipe 110 is connected to an ink tank 114 for storing the ink.

The ink tank 114 includes a supply subtank 114A, to which the other end of the flow path pipe 110 is connected, a main tank 114B, in which the ink is mainly stored, and a circulation subtank 114C to which the other end of the flow path pipe 112 is connected.

A flow path pipe 120 is interposed between the supply subtank 114A and the main tank 114B to communicate the supply subtank 114A with the main tank 114B. A pump 122 is disposed to the flow path pipe 120 to supply the ink from the main tank 114B to the supply subtank 114A. A flow path pipe 124 is interposed between the main tank 114B and the circulation subtank 114C to communicate the main tank 114B with the circulation subtank 114C, and a pump 126 is disposed to the flow path pipe 124 to supply the ink from the circulation subtank 114C to the main tank 114B.

An up/down drive mechanism 140 is disposed to the supply subtank 114A to move it up and down, and an up/down drive mechanism 142 is disposed to the circulation subtank 114C to move it up and down and the up/down drive mechanisms 140 and 142 act as a circulation unit, thereby the supply subtank 114A and the circulation subtank 114C can be moved up and down.

A filter 132 for filtrating the ink and an open/close valve 134 which is capable of open/close, are disposed to the flow path pipe 112 on the liquid droplet ejection head 20 side thereof, the flow path pipe 112 having the one end connected to the second main flow path 54 and the other end connected to the circulation subtank 1114C.

Further, the flow path pipe 112 is branched to a branch flow path pipe 112A and a branch flow path pipe 112B on the circulation subtank 114C side thereof. A pump 130 is disposed to the branch flow path pipe 112A to cause the ink to flow from the circulation subtank 114C to the liquid droplet ejection head 20, and an open/close valve 136 which are capable of open/close, is disposed to the branch flow path pipe 112B.

The maintenance unit 40 includes a storage liquid tank 144, in which a storage liquid from which components such as pigment, resin and the like liable to be solidified are removed are stored, and a flow path pipe 148 for communicating the flow path pipe 112 between the filter 132 and the open/close valve 134 with the storage liquid tank 144.

An open/close valve 154 which are capable of open/close, and a pump 156 are disposed to the flow path pipe 148 on the storage liquid tank 144 side thereof, and the pump 156 supplies the storage liquid from the storage liquid tank 144 to the liquid droplet ejection head 20 through the flow path pipe 112.

Further, the maintenance unit 40 includes an ink controller 160 for controlling the outputs of the pumps 122, 126, 130, and 156, and the opening/closing of the open/close valves 118, 134, 136, and 154. Further, the maintenance unit 40 includes the liquid viscosity-increase prevention controller 162 which determines the upper and lower positions (upper and lower positions shown in FIG. 1) of the supply subtank 114A and the circulation subtank 114C by controlling the up/down drive mechanisms 140 and 142. That is, the liquid viscosity-increase prevention controller 162 controls the preliminary waveform applied to the actuator 62 described above and the up/down drive mechanisms 140 and 142.

(Operation/Working Effect)

Next, an operation of the inkjet recording apparatus 10 will be explained.

As shown in FIG. 5, the sheet material P is supplied onto the transport belt 30 by the pick-up roller 24 and the transport rollers 25. The sheet material P, which is supplied onto the transport belt 30 and adsorbed and held thereby, is supplied to the recording position of the liquid droplet ejection head 20, and an image is recorded on the print surface thereof.

In more detail, a drive waveform based on image information is applied to the drive element 66 through the circuit substrate 72 as shown in FIG. 2. The drive element 66, to which the drive waveform is applied, contracts or expands the volume in the pressure chamber 60 by changing the pressure force to the diaphragm 64. That is, the ink accumulated in the pressure chamber 60 is ejected from the nozzle 42 through the communication path 58 by the change of the volume of the pressure chamber 60, and the image is recorded onto the sheet material P. After the image is recorded, the sheet material P is exfoliated from the transport belt 30 and transported to the sheet discharge unit 18 by transport rollers 38.

Note that a preliminary waveform is applied to the actuator 62 by the liquid viscosity-increase prevention controller 162 through the circuit substrate 72. The actuator 62, to which the preliminary waveform is applied, vibrates a meniscus of the nozzle 42 by applying pressure to the ink in the pressure chamber 60. With this operation, the increase of viscosity of the ink is prevented, and the preliminary waveform will be described later in detail.

Next, a method of circulating the ink in the liquid droplet ejection head will be explained.

As shown in FIG. 1, first, the ink controller 160 closes the open/close valve 154 and opens the other open/close valves 118, 134, 136. Further, the ink controller 160 operates the pump 126 to cause the ink to flow from the circulation subtank 114C to the main tank 114B and operates the pump 122 to cause the ink to flow from the main tank 114B to the supply subtank 114A.

In contrast, the liquid viscosity-increase prevention controller 162 operates the up/down drive mechanisms 140 and 142 and makes the height of the liquid surface of the ink stored in the supply subtank 114A higher than that of the ink stored in the circulation subtank 114C. More specifically, the ink is supplied to the liquid droplet ejection head 20 through the flow path pipe 110, collected from the liquid droplet ejection head 20 through the flow path pipe 112, and circulated between the ink tank 114 and the liquid droplet ejection head 20 by providing a so-called water head difference.

That is, as shown in FIGS. 2 and 3, the ink supplied to the liquid droplet ejection head 20 passes through the first main flow path 52, further flows in the first branch flow path 48 branching and extending from the first main flow path 52, and flows into the pressure chamber 60 of each ejector 46 through the supply path 98. Further, the ink, which flows into the pressure chamber 60, passes through the communication path 58 and the discharge path 104 of the ejector 46 and flows through the second branch flow path 50 to flow into the second main flow path 54. The ink that has flowed into the second main flow path 54 flows into the flow path pipe 112 and is collected in the ink tank 114.

Next, a procedure for capping the liquid droplet ejection head 20 when it is inactive for a long time will be explained based on a flowchart.

Figure 6:
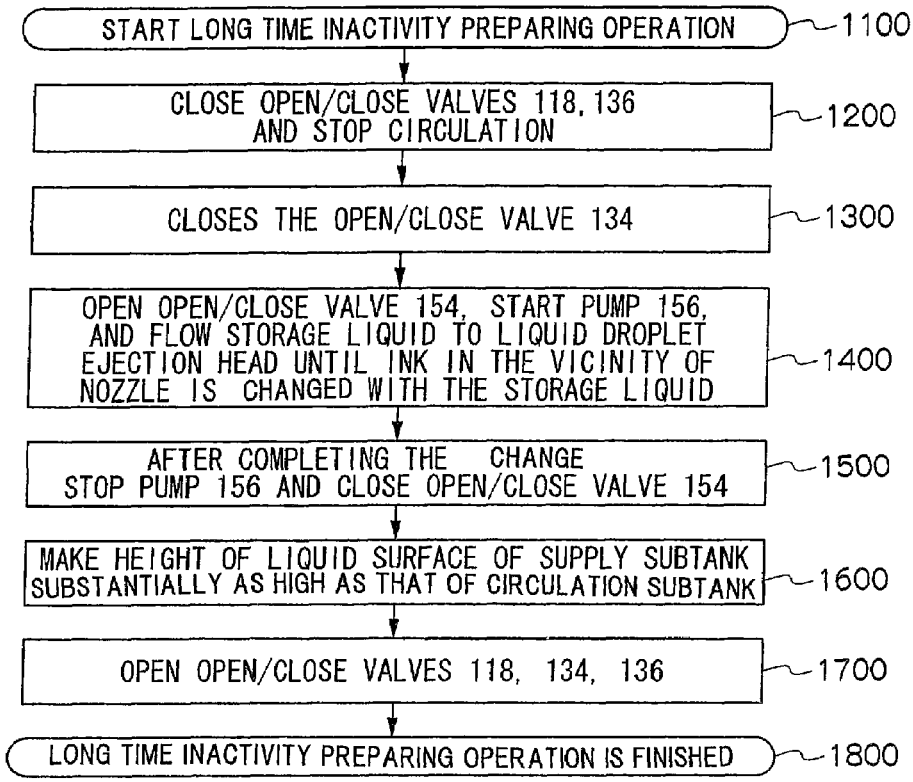
FIG. 6 is a flowchart of a long time inactivity preparing operation of the liquid droplet ejection head according to the first exemplary embodiment of the invention.

As shown in FIG. 6, when the liquid droplet ejection head 20 is inactive for a predetermined time, the circulation of the ink and the application of the preliminary waveform are stopped at step 1100 and, further, each liquid droplet ejection head 20 is lifted to a predetermined height, the cap members 44 are positioned in opposition to the nozzle surfaces 96 of the liquid droplet ejection head 20 (refer to FIG. 4), and the process proceeds to step 1200.

At step 1200, the ink controller 160 closes the open/close valves 118 and 136 and, further, stops the circulation of the ink by stopping the pumps 122 and 126, and the process proceeds to step 1300.

At step 1300, the ink controller 160 closes the open/close valve 134, and the process proceeds to step 1400.

At step 1400, the ink controller 160 opens the open/close valve 154 and operates the pump 156.

As a result, the storage liquid is caused to flow from the storage liquid tank 144 to the liquid droplet ejection head 20, the ink is ejected from the nozzle 42 shown in FIG. 2 to the ink receiver (not shown), the liquid in the vicinity of the nozzle is changed from the ink to the storage liquid, and the process proceeds to step 1500.

At step 1500, the ink controller 160 completes the change of the ink with the storage liquid by stopping the pump 156 and closes the open/close valve 154, and the process proceeds to step 1600.

At step 1600, the liquid viscosity-increase prevention controller 162 operates the up/down drive mechanisms 140 and 142 and makes the height of the liquid surface of the supply subtank 114A substantially as high as that of the circulation subtank 114C, and the process proceeds to step 1700.

At step 1700, the ink controller 160 opens the open/close valves 118, 134, and 136 and causes the cap members 44 to tightly contact with the nozzle surface 96, and the process proceeds to step 1800, whereby the operation of preparation for extended inactivity is completed.

Next, a restart preparation operation for permitting the liquid droplet ejection head 20 to eject a liquid droplet from the state that the nozzle surfaces 96 are capped will be explained based on a flowchart.

Figure 7:
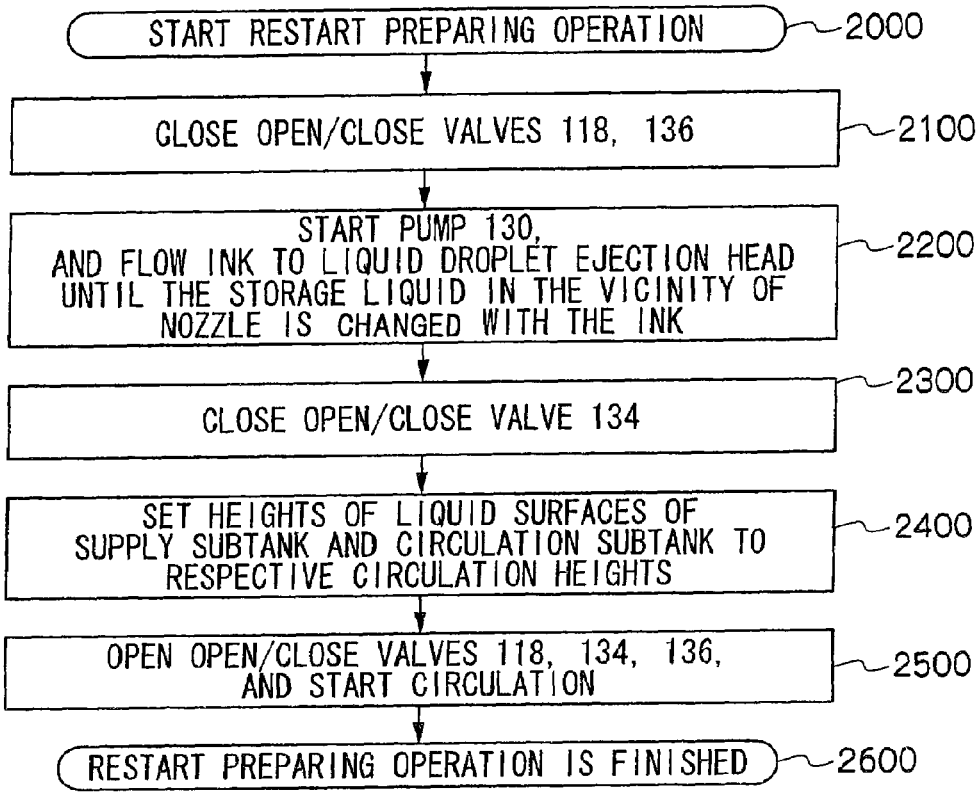
FIG. 7 is a flowchart of a restart preparing operation of the liquid droplet ejection head according to the first exemplary embodiment of the invention.

As shown in FIG. 7, the cap members 44 are separated from the nozzle surfaces 96 at step 2000, the nozzle surfaces 96 are opened, and the process proceeds to step 2100.

At step 2100, the ink controller 160 closes the open/close valves 118, 136, and the process proceeds to step 2200.

At step 2200, the ink controller 160 operates the pump 130.

As a result, the ink is caused to flow from the circulation subtank 114C to the liquid droplet ejection head 20, the storage liquid is ejected from the nozzle 42 shown in FIG. 2 to the ink receiver (not shown), the liquid in the vicinity of the nozzle is changed from the storage liquid to the ink, and the process proceeds to step 2300.

At step 2300, the ink controller 160 closes the open/close valve 134, and the process proceeds to step 2400.

At step 2400, the liquid viscosity-increase prevention controller 162 operates the up/down drive mechanisms 140 and 142 and generates a water head difference by making the height of the liquid surface of the supply subtank 114A higher than that of the circulation subtank 114C, and the process proceeds to step 2500.

At step 2500, the ink controller 160 opens the open/close valves 118, 134, 136 and operates the pumps 122 and 126 so as to circulate the ink, and the process proceeds to step 2600, whereby the restart preparation operation is completed.

Next, the amount of circulation of the ink when the nozzle surfaces 96 of the liquid droplet ejection head 20 are not capped will be explained.

As shown in FIG. 1, the liquid viscosity-increase prevention controller 162 operates the up/down drive mechanisms 140 and 142 and generates the water head difference by making the height of the liquid surface of the supply subtank 114A higher than that of the circulation subtank 114C so that the ink circulates in the liquid droplet ejection head 20.

That is, as shown in FIG. 2, the increase of viscosity of the ink in the vicinity of the nozzle 42 is suppressed by circulating the ink in the communication path 58 disposed above the nozzle 42.

The liquid viscosity-increase prevention controller 162 changes the amount of circulation of the ink flowing in the ejector 46 when the ink is ejected from the nozzle 42 as a liquid droplet, and when ejection of liquid droplets is suspended and ink is not ejected from the nozzle 42, by controlling the up/down drive mechanisms 140 and 142.

More specifically, when a liquid droplet is ejected, the amount of circulation of the ink is set such that the ejection stability and the ejection directionality of the liquid droplet ejected from the nozzle 42 are not adversely affected by the amount of circulation of the ink. For this purpose, the liquid viscosity-increase prevention controller 162 sets the difference (water head difference) between the heights of the liquid surface of the supply subtank 114A and that of the circulation subtank 114C such that an amount of circulation of the ink that does not adversely affect the liquid droplet ejected from the nozzle 42 can be obtained.

In contrast, the water head difference when ejection of liquid droplets is suspended is set to a largest water head difference in consideration of the heights of the supply subtank 114A and of the circulation subtank 114C and the operation limits of the up/down drive mechanisms 140 and 142, whereby the ink is circulated in the ejector 46 in the amount larger than that when a liquid droplet is ejected.

Further, even if the ink is circulated in a large amount, no ink overflows from the nozzle 42 and no air is sucked in at the nozzle 42 if the back pressure of the ink in the nozzle 42 is set within an allowable range.

Next, a preliminary waveform when the nozzle surfaces 96 of the liquid droplet ejection head 20 are not capped will be explained.

As shown in FIG. 2, the liquid viscosity-increase prevention controller 162 applies the preliminary waveform to the actuator 62 through the circuit substrate 72 and applies pressure to the ink in the pressure chamber 60 to thereby vibrate the meniscus of the nozzle 42. As a result, an increase in the viscosity of the ink in the vicinity of the nozzle 42 is prevented.

The liquid viscosity-increase prevention controller 162 changes the preliminary waveform applied to the actuator 62 when the ink is ejected from the nozzle 42 as a liquid droplet and when ejection of liquid droplets is suspended and ink is not ejected.

More specifically, when a liquid droplet is ejected, a preliminary waveform is applied that does not adversely affect the ejection stability or the ejection directionality of the liquid droplet ejected from the nozzle 42, and when the ejection of liquid droplets is suspended, a preliminary waveform is applied according to which no liquid is leaked from the nozzle 42 and no air is sucked in by the nozzle 42.

As described above, since the preliminary waveform is changed when a liquid droplet is ejected and when the ejection of a liquid droplet is paused, the preliminary waveform can be optimized according to the respective cases as compared with the occasion that the same preliminary waveform is used in both the cases. As a result, the frequency of preliminary ejection can be reduced while the increase of viscosity of the liquid in the vicinity of the nozzle 42 is suppressed, thereby the amount of the waste ink caused by the preliminary ejection (amount of waste liquid) can be reduced.

As described above, since the amount of circulation of the ink is changed when the liquid droplet is ejected and when the ejection of the liquid droplet is paused, the amount of circulation of the ink can be optimized according to the respective cases as compared with the occasion that the same amount of circulation of the ink is used in both the cases. As a result, the frequency of the preliminary ejection can be reduced while the increase of viscosity of the liquid in the vicinity of the nozzle 42 is suppressed, thereby the amount of the waste ink caused by the preliminary ejection (amount of waste liquid) can be reduced.

Since the amount of waste ink (amount of waste liquid) caused by the preliminary ejection performed by the liquid droplet ejection head 20 can be reduced, the inkjet recording apparatus 10 whose maintenance cost is less expensive can be provided.

The solidification of the liquid in the vicinity of the nozzle being inactive can be effectively suppressed by replacing the ink in the vicinity of the nozzle 42 with the storage liquid before the nozzle 42 is capped.

When the liquid droplet ejection head 20 is inactive for the predetermined time, since the circulation of the ink and the application of the preliminary waveform are stopped and the nozzle 42 capped, the power and like necessary to circulate the ink can be saved.

Further, when the liquid droplet ejection head 20 is inactive for the predetermined time, since the application of the preliminary waveform is stopped, power consumption can be saved and the life of the drive element 66 can be improved.

The inventors of the invention investigated the relation among the time elapsed after a final liquid droplet was ejected from the nozzle 42, the liquid droplet speed of a liquid droplet ejected from the nozzle 42 after the time elapsed, the amount of circulation of the ink, and the preliminary waveform.

Figure 8A:
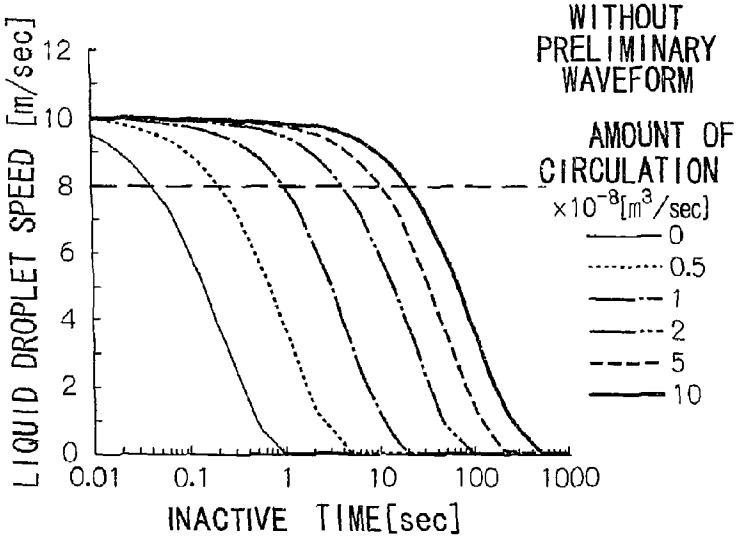
FIG. 8A is a graph showing the relation among a preliminary waveform, an ink amount of circulation, a liquid droplet speed, and the like for confirming the effect of the liquid droplet ejection head according to the first exemplary embodiment of the invention.

FIG. 8A is a graph showing the liquid droplet speed of the ink when no preliminary waveform is applied, with the horizontal axis showing the time elapsed since the last liquid droplet was ejected from the nozzle 42 and the vertical axis showing the liquid droplet speed. In FIG. 8A, each curved lines is shown by a different type of line corresponding to a different amount of circulation of the ink. As is also apparent from the graph, a smaller amount of circulation of the ink more reduces the liquid droplet speed in a shorter time. When the liquid droplet speed is reduced, the position of the sheet material P at which the ink lands is offset, whereby an output image is deteriorated. In addition, the amount of circulation shows the amount of circulation per one head.

When a reference liquid droplet speed is set to 10 m/s at the time the distance between the nozzle 42 and the sheet material P is set to $1.0\times10^{-3}$ m, a landing position is offset by 9.5 μm when the liquid droplet speed is 8 m/s, by 16.3 μm when the liquid droplet speed is 7 m/s, and by 25.4 μm when the liquid droplet speed is 6 m/s. On the other hand, when resolution in a scanning direction is 1200 dpi, a dot pitch in the scanning direction is 21.2 μm. It can be contemplated from the above-mentioned that a liquid droplet speed, which is allowed to suppress the deterioration of the output image, is, for example, 8 m/s or more.

Figure 8B:
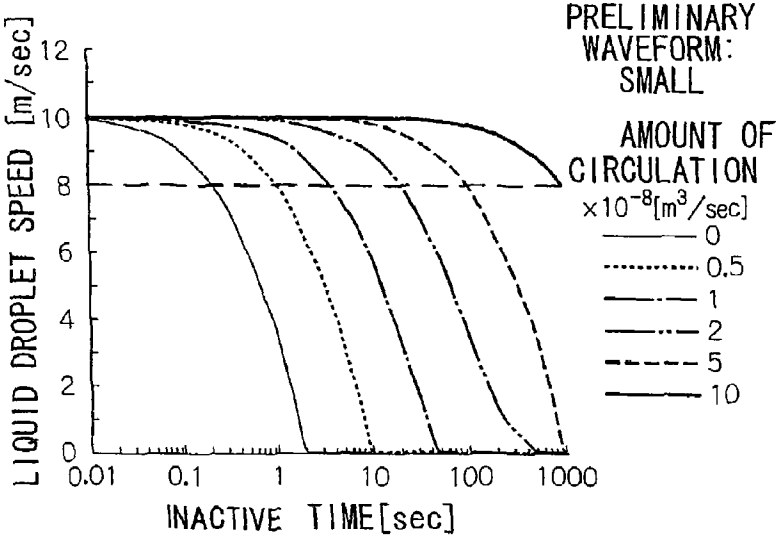
FIG. 8B is a graph showing the relation among the preliminary waveform, the ink amount of circulation, the liquid droplet speed, and the like for confirming the effect of the liquid droplet ejection head according to the first exemplary embodiment of the invention.
Figure 9A:
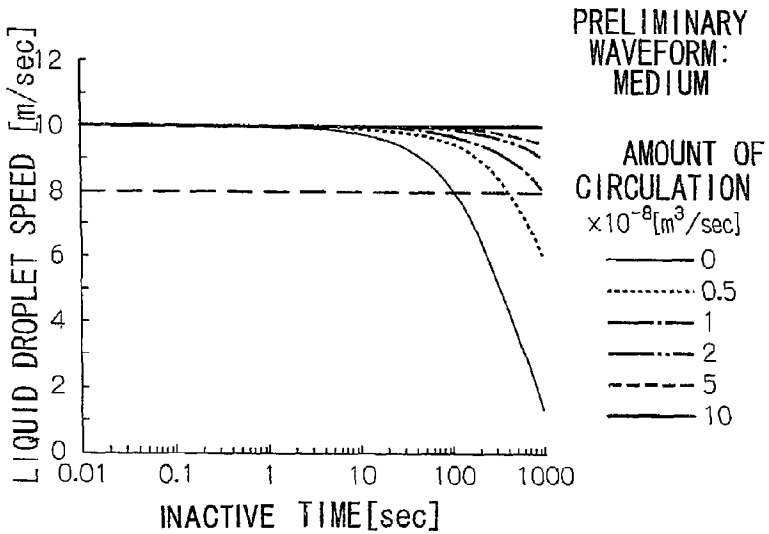
FIG. 9A is a graph showing the relation among the preliminary waveform, the ink amount of circulation, the liquid droplet speed, and the like for confirming the effect of the liquid droplet ejection head according to the first exemplary embodiment of the invention.
Figure 9B:
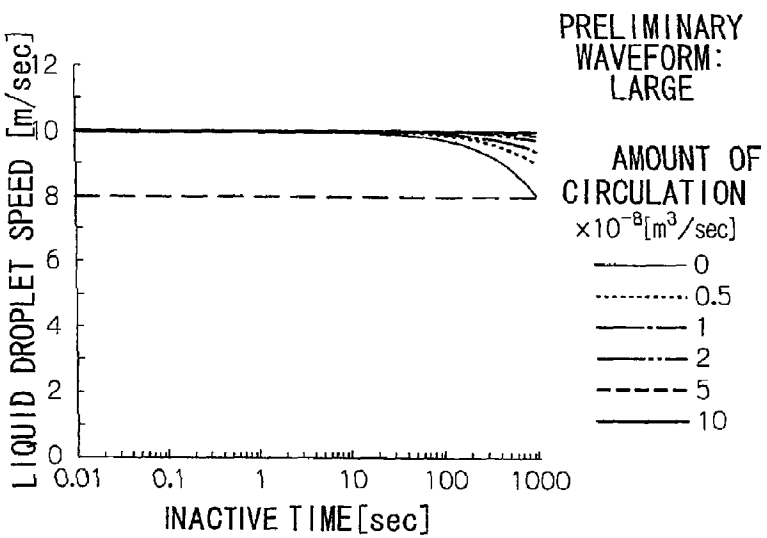
FIG. 9B is a graph showing the relation among the preliminary waveform, the ink amount of circulation, the liquid droplet speed, and the like for confirming the effect of the liquid droplet ejection head according to the first exemplary embodiment of the invention.

Further, FIG. 8B shows a case when a small preliminary waveform is applied, FIG. 9A shows a case that a medium preliminary waveform is applied, and FIG. 9B shows a case that a large preliminary waveform is applied. It can be found that a larger preliminary waveform does not reduce the liquid droplet speed of the ink even if an inactive time is long. That is, as shown in FIG. 9B, when the large preliminary waveform is applied, the liquid droplet speed remains 8 m/s or more even if a time elapses.

The preliminary waveforms shown in FIGS. 10A to 10C will be explained below in detail.

A binary digital waveform, which is created using a direct current power supply and a switching device, is used as the preliminary waveform to be applied to the drive element. The rising time and the falling time of the drive waveform depends on the capacitance of the drive element and the resistance of the switching device. Here, it is set to 1.0 μsec.

Figure 10A:
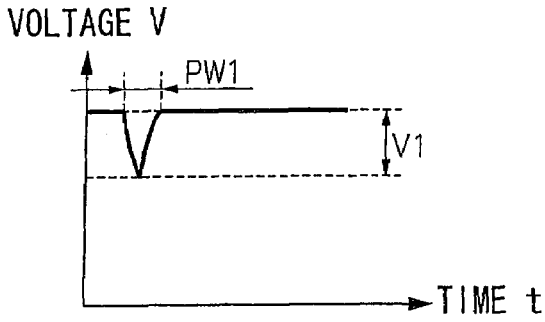
FIG. 10A is a graph showing the preliminary waveform for confirming the effect of the liquid droplet ejection head according to the first exemplary embodiment of the invention.
Figure 10B:
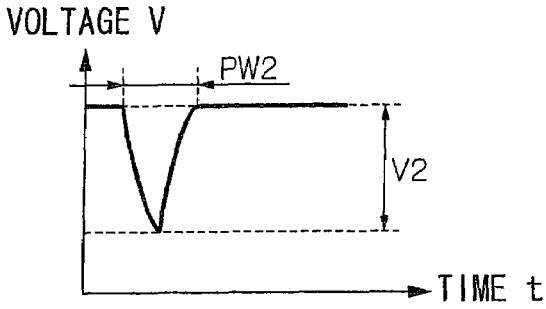
FIG. 10B is a graph showing the preliminary waveform for confirming the effect of the liquid droplet ejection head according to the first exemplary embodiment of the invention.
Figure 10C:
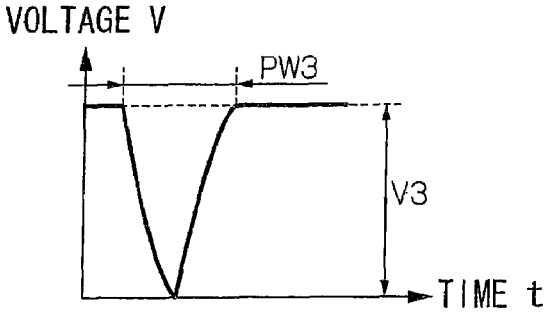
FIG. 10C is a graph showing the preliminary waveform for confirming the effect of the liquid droplet ejection head according to the first exemplary embodiment of the invention.

The voltage amplitude of the preliminary waveforms shown in FIGS. 10A to 10C is controlled by adjusting the turning-on time of the switching device respectively connected to a high voltage direct current terminal (HV) and a low voltage direct current terminal (GND), to within the range of the rising time or less to the falling time or less thereof. In the example, PW1 to PW3 and V1 to V3 have the following relations.

PW1 (preliminary waveform: small): 0.5 μsec V3: 6 V

PW2 (preliminary waveform: medium): 1.0 μsec V3: 12 V

PW3 (preliminary waveform: large): 2.0 μsec V3: 18 V

Further, the preliminary waveform has the same drive frequency when the liquid droplet is ejected and when the ejection of the liquid droplet is suspended, and the drive frequency is set to 18 kHz. Accordingly, the preliminary waveform is applied to a non-driving nozzle at the same timing at which a driving nozzle ejects a liquid droplet.

FIG. 11A shows the time that must elapse after a previous liquid droplet is ejected from a nozzle for a liquid droplet speed of 8 m/s or more to be maintained, by respective preliminary waveforms and amounts of circulation. That is, when no preliminary waveform is applied and no ink is circulated, the liquid droplet speed reaches 8 m/s 0.04 seconds after the previous liquid droplet is ejected. In contrast, when the small preliminary waveform is applied and the ink is circulated in the amount of $5.0\times10^{-8}$ $m^3/s$, the liquid droplet speed reaches 8 m/s 100 seconds after the previous liquid droplet is ejected.

Further, FIG. 11B shows the ejection stability of the liquid droplet by gradings G (Good) and B (Bad) with respect to the respective preliminary waveforms and amounts of circulation. Further, the ejection stability is determined by observation of an ejected liquid droplet itself, the result of printing a test chart, and the like. That is, when the preliminary waveform is large, the ejection stability is graded B for circulation amounts. Further, when the preliminary waveform is small and the amount of circulation is $5.0\times10^{-8}$ $m^3/s$, the ejection stability is graded G, whereas when the preliminary waveform is small and the amount of circulation is $10.0\times10^{-8}$ $m^3/s$, the ejection stability is graded B.

From the results of FIGS. 11A and 11B, when no preliminary waveform is applied and the amount of circulation is $10.0\times10^{-8}$ $m^3/s$, the elapsed time with which the ejection stability can be graded G and the liquid droplet speed of 8 m/s or more can be maintained, is 20 s, which is a combination of a satisfactory ejection stability and a long elapsed time after the final liquid droplet is ejected from a nozzle with which a liquid droplet speed of 8 m/s or more can be maintained. When the preliminary waveform is small and the amount of circulation is $2.0\times10^{-8}$ $m^3/s$, the elapsed time with which the ejection stability can be graded G and a liquid droplet speed of 8 m/s or more can be maintained, is 20 s. When the preliminary waveform is small and the amount of circulation is $5.0\times10^{-8}$ $m^3/s$, the elapsed time with which the ejection stability can be graded G and a liquid droplet speed of 8 m/s or more can be maintained, is 100 s.

When the preliminary waveform is medium and no ink is circulated ($0.0\times10^{-8}$ $m^3/s$), the elapsed time, by which the ejection stability can be graded G and the liquid droplet speed of 8 m/s or more can be maintained, is 100 s. Further, when the preliminary waveform is medium and the amount of circulation is $0.5\times10^{-8}$ $m^3/s$, the elapsed time, by which the ejection stability can be graded G and the liquid droplet speed of 8 m/s or more can be maintained, is 400 s.

It is also evident from the above results that the elapsed time after the final liquid droplet is ejected from the nozzle with which a liquid droplet speed of 8 m/s or more can be maintained can be prolonged by appropriately selecting the amount of circulation of the ink in the ejector and the preliminary waveform to be applied. That is, it is evident that when the amount of circulation of the ink and the preliminary waveform are set based on the above results at the time of liquid droplet ejection, the ejection stability can be satisfied and, further, the elapsed time after the final liquid droplet is ejected from the nozzle with which a liquid droplet speed of 8 m/s or more can be maintained, can be prolonged. As a result, the frequency of preliminary ejection can be reduced. Further, it is found from the results of the investigation of the inventors that the amount of waste ink (amount of waste liquid) can be reduced by reducing the frequency of preliminary ejection.

Next, a second exemplary embodiment of the image forming apparatus, to which the liquid droplet ejection head of the invention is employed, will be explained according FIGS. 12 and 13.

Note that the same components as those of the first exemplary embodiment are denoted by the same reference numerals and the explanation thereof is omitted.

Figure 12:
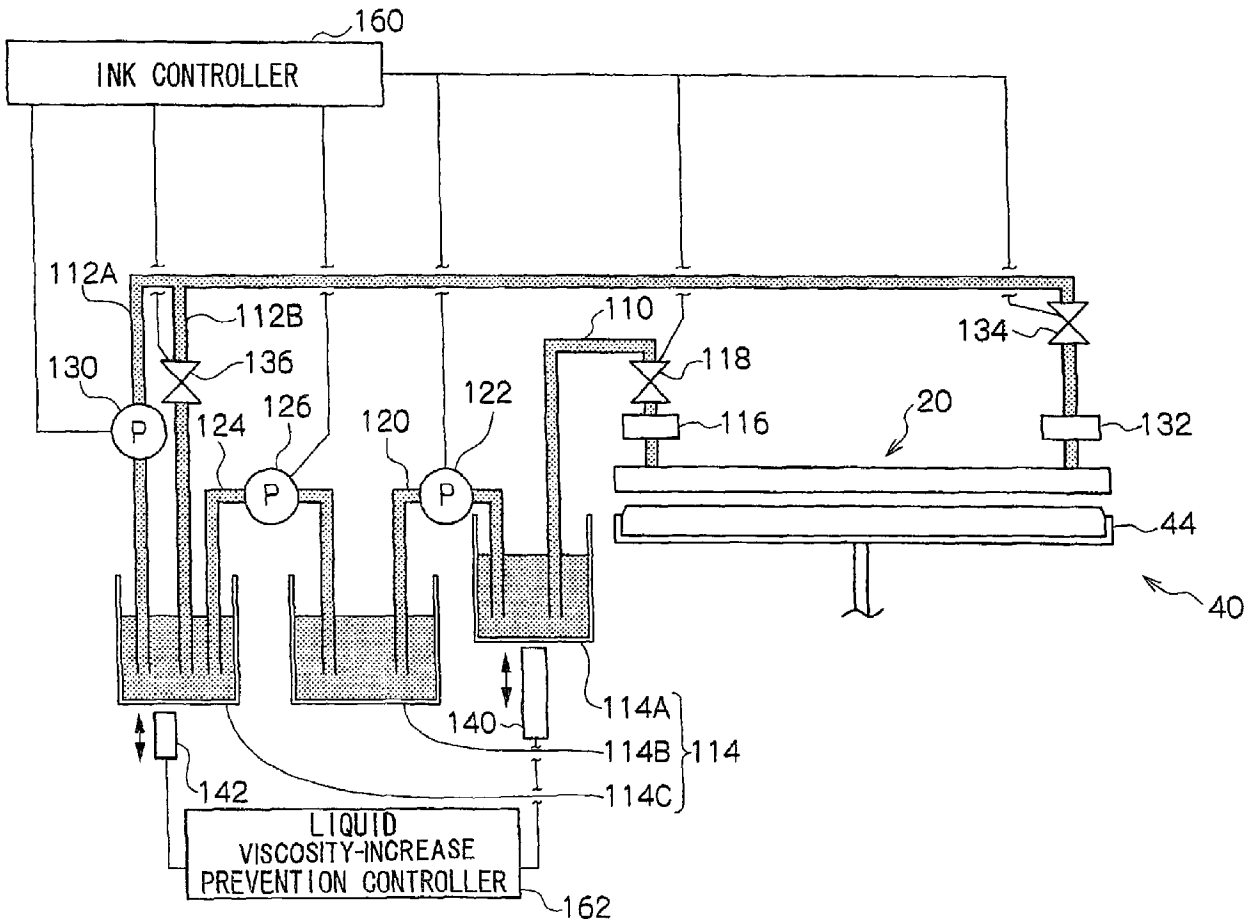
FIG. 12 is a schematic arrangement view showing a liquid droplet ejection head, ink tanks, and the like according to a second exemplary embodiment of the invention.

As shown in FIG. 12, the exemplary embodiment includes no storage liquid tank different from the first exemplary embodiment. That is, even if a liquid droplet ejection head 20 is capped when it is inactive for a long time, the ink in the vicinity of a nozzle 42 is not changed with storage liquid.

The circulation of ink will be explained when the liquid droplet ejection head 20, which is inactive for the long time and the nozzle surface 96 of which is capped, is uncapped from a cap member 44.

When the nozzle 42 is uncapped from the cap member 44, a liquid viscosity-increase prevention controller 162 operates up/down drive mechanisms 140 and 142 and generates a water head difference by making the height of the liquid surface of a supply subtank 114A higher than the height of the liquid surface of the circulation subtank 114C. Further, an ink controller 160 operates pumps 122 and 126. The water head difference is set to a largest water head difference in consideration of the heights of the supply subtank 114A and the circulation subtank 114C and the operation limits of the up/down drive mechanisms 140 and 142. As described above, an ink, which is larger than that when a liquid droplet ejected, is circulated in an ejector 46 before the liquid droplet is ejected from the nozzle 42.

Further, when the nozzle 42 is uncapped from the cap members 44, the liquid viscosity-increase prevention controller 162 vibrates a meniscus of the nozzle 42 by applying a preliminary waveform to an actuator 62. Here, the preliminary waveform, which prevents a liquid from being leaked from the nozzle 42 and air from being sucked thereby, is applied to actuator 62. As described above, the preliminary waveform, which is larger than that when the liquid droplet is ejected, is applied to the actuator 62 before the liquid droplet is ejected from the nozzle 42.

Even when the nozzle 42 is capped by the cap member 44, the viscosity of the ink in the vicinity of the nozzle 42 is somewhat increased. To cope with this problem, a preliminary ejection, which has no relation to image information, is necessary before the nozzle 42 is uncapped from the cap member 44 and ejects a liquid droplet for forming an image.

As described above, the increase of viscosity of the ink can be effectively prevented by making the amount of circulation of the ink in the ejectors 46 larger than that when the liquid droplet is ejected from the nozzle 42 (when the liquid droplet is ejected) and further making the preliminary waveform applied to the actuator 62 larger than that when the liquid droplet is ejected before the nozzle 42 is uncapped from the cap member 44 and the liquid droplet is ejected from the nozzle 42. As a result, the amount of waste ink (amount of waste liquid) caused by the preliminary ejection can be reduced.

The inventors of the invention investigated the relation among the number of times of the preliminary ejection, which was necessary for a liquid droplet speed to return to an ordinary speed of 10 m/sec after the nozzle 42 was capped and inactive for 12 hours and then uncapped from the cap member, the amount of circulation of the ink, and the preliminary waveform.

In more detail, the time until a preliminary ejecting operation was started after the nozzle 42 was uncapped from the cap member 44 was set to 10 sec, and the necessary number of times of the preliminary ejection was measured after the ink was circulated and the preliminary waveform was applied during the above time (from the uncapping of the cap member 44 to the preliminary ejection). Note that the drive frequency of the preliminary waveform was 18 kHz.

A result of the investigation is summarized in FIG. 13, which also shows that the number of times of the preliminary ejection can be reduced by increasing the amount of circulation of the ink and the preliminary waveform. That is, it can be found from the result of investigation of the inventors that the amount of waste ink (amount of waste liquid) can be reduced by reducing the number of times of the preliminary ejection.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejection head comprising:

an ejector including a nozzle for ejecting a liquid droplet, a pressure chamber communicating with the nozzle through a communication path, and an actuator for applying pressure to a liquid in the pressure chamber;

a first fluid flow path in which the liquid supplied to the pressure chamber of the ejector flows;

a second fluid flow path into which the liquid supplied from the first fluid flow path to the pressure chamber flows through the communication path;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path; and a liquid viscosity-increase prevention controller for changing the operation frequency of the liquid viscosity-increase prevention structure between when the liquid droplet is ejected from the nozzle and when ejection of the liquid droplet is paused and no liquid droplet is being ejected from the nozzle, the liquid viscosity-increase prevention controller changing the amount of circulation of the liquid flowing in the ejector by controlling the circulation unit when the liquid droplet is ejected from the nozzle and when ejection of the liquid droplet is paused.

2. The liquid droplet ejection head of claim 1, further comprising a supply subtank connected to the ink supplied to the first fluid flow path, a circulation subtank connected to the ink discharged to the second fluid flow path, and a main tank connected to the supply subtank and to the circulation subtank respectively between the supply subtank and the circulation subtank, wherein the circulation unit is an up/down drive mechanism for moving the supply subtank and the circulation subtank up and down.

3. The liquid droplet ejection head of claim 2, wherein the liquid viscosity-increase prevention controller increases the amount of circulation of the liquid by making the difference between the heights of the liquid surfaces of the circulation subtank and the supply subtank when ejection of the liquid is paused larger than the difference between the heights of the liquid surfaces of the circulation subtank and the supply subtank when the liquid droplet is ejected.

4. The liquid droplet ejection head of claim 1, wherein:

the liquid viscosity-increase prevention structure is an actuator; and the liquid viscosity-increase prevention controller changes a preliminary waveform applied to the actuator between when the liquid droplet is ejected and when the ejection of the liquid droplet is paused.

5. A liquid droplet ejection head comprising:

an ejector including a nozzle for ejecting a liquid droplet, a pressure chamber communicating with the nozzle through a communication path, and an actuator for applying pressure to a liquid in the pressure chamber;

a cap member for preventing evaporation of a liquid by capping the nozzle;

a first fluid flow path in which the liquid supplied to the pressure chamber of the ejector flows;

a second fluid flow path into which the liquid supplied from the first fluid flow path to the pressure chamber flows through the communication path;

a liquid viscosity-increase prevention structure for preventing an increase of viscosity of the liquid in the ejector, the liquid viscosity-increase prevention structure being a circulation unit for circulating the liquid to the ejector through the first fluid flow path and from the ejector through the second fluid flow path; and a liquid viscosity-increase prevention controller for operating the liquid viscosity-increase prevention structure before the nozzle is uncapped from the cap member and ejects a liquid droplet, the liquid viscosity-increase prevention controller circulating a liquid in the ejector by operating the circulation unit before the nozzle is uncapped from the cap member and ejects a liquid droplet.

6. The liquid droplet ejection head of claim 5, wherein the amount of circulation of the liquid circulated to the ejector by the circulation unit under the control of the liquid viscosity-increase prevention controller before the nozzle ejects the liquid droplet is larger than the amount of circulation of the liquid when the liquid droplet is being ejected from the nozzle.

7. The liquid droplet ejection head of claim 5, further comprising a supply subtank connected to the ink supplied to the first fluid flow path, a circulation subtank connected to the ink discharged to the second fluid flow path, and a main tank connected to the supply subtank and to the circulation subtank respectively between the supply subtank and the circulation subtank, wherein the circulation unit is an up/down drive mechanism for moving the supply subtank and the circulation subtank up and down.

8. The liquid droplet ejection head of claim 7, wherein the liquid viscosity-increase prevention controller makes the difference between the heights of the liquid surfaces of the circulation subtank and the supply subtank before the nozzle ejects a liquid droplet larger than the difference between the heights of the liquid surfaces of the circulation subtank and the supply subtank when the liquid droplet is ejected from the nozzle.

9. The liquid droplet ejection head of claim 8, wherein when the nozzle is capped by the cap member, the liquid viscosity-increase prevention controller makes the height of the liquid surface of the supply subtank substantially as high as that of the circulation subtank.

10. The liquid droplet ejection head of claim 8, further comprising a storage liquid tank in which a storage liquid, from which components liable to be solidified have been removed, is stored, wherein when the nozzle is capped by the cap member, the ink in the vicinity of the nozzle is changed with the storage liquid.

11. The liquid droplet ejection head of claim 10, wherein the storage liquid in the vicinity of the nozzle is changed with ink before the nozzle ejects the liquid droplet.

12. The liquid droplet ejection head of claim 5, wherein:

the liquid viscosity-increase prevention structure is an actuator; and the liquid viscosity-increase prevention controller vibrates the meniscus of the nozzle by applying a preliminary waveform to the actuator before the nozzle is uncapped from the cap member and before the liquid droplet is ejected.

13. The liquid droplet ejection head of claim 12, wherein the preliminary waveform, which is applied to the actuator by the liquid viscosity-increase prevention controller before the nozzle ejects the liquid droplet, is larger than the preliminary waveform when the liquid droplet is ejected from the nozzle.

14. An image forming apparatus having a liquid droplet ejection head, the liquid droplet ejection head comprising:

an ejector including a nozzle for ejecting a liquid droplet, a pressure chamber communicating with the nozzle through a communication path, and an actuator for applying pressure to a liquid in the pressure chamber;

a first fluid flow path in which the liquid supplied to the pressure chamber of the ejector flows;

a second fluid flow path into which the liquid supplied from the first fluid flow path to the pressure chamber flows through the communication path;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path; and a liquid viscosity-increase prevention controller for changing the operation frequency of the liquid viscosity-increase prevention structure between when the liquid droplet is ejected from the nozzle, and when ejection of the liquid droplet is paused and no liquid droplet is being ejected from the nozzle, the liquid viscosity-increase prevention controller changing the amount of circulation of the liquid flowing in the ejector by controlling-the circulation unit when the liquid droplet is ejected from the nozzle and when ejection of the liquid droplet is paused.

15. An image forming apparatus having a liquid droplet ejection head, the liquid droplet ejection head comprises:

an ejector including a nozzle for ejecting a liquid droplet, a pressure chamber communicating with the nozzle through a communication path, and an actuator for applying pressure to a liquid in the pressure chamber, a cap member for preventing evaporation of a liquid by capping the nozzle;

a first fluid flow path in which the liquid supplied to the pressure chamber of the ejector flows;

a second fluid flow path into which the liquid supplied from the first fluid flow path to the pressure chamber flows through the communication path;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path; and a liquid viscosity-increase prevention controller for operating the liquid viscosity-increase prevention structure before the nozzle is uncapped from the cap member and ejects a liquid droplet, the liquid viscosity-increase prevention controller circulating a liquid in the ejector by operating the circulation unit before the nozzle is uncapped from the cap member and ejects a liquid droplet.

16. A liquid droplet ejection head comprising:

an ejector including a nozzle for ejecting a liquid droplet, a pressure chamber communicating with the nozzle through a communication path, and an actuator for applying pressure to a liquid in the pressure chamber;

a first fluid flow path in which the liquid supplied to the pressure chamber of the, ejector flows;

a second fluid flow path into which the liquid supplied from the first fluid flow path to the pressure chamber flows through the communication path;

a supply subtank connected to the ink supplied to the first fluid flow path, a circulation subtank connected to the ink discharged to the second fluid flow path, and a main tank connected to the supply subtank and, to the circulation subtank respectively between the supply subtank and the circulation subtank;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path, the circulation unit being an up/down drive mechanism for moving the supply subtank and the circulation subtank up and down;

a liquid viscosity-increase prevention controller for changing the operation frequency of the liquid viscosity-increase prevention structure between when the liquid droplet is ejected from the nozzle and when ejection of the liquid droplet is paused and no liquid droplet is being ejected from the nozzle.

17. An image forming apparatus having a liquid droplet ejection head, the liquid droplet ejection head comprising:

an ejector including a nozzle for ejecting a liquid droplet, a pressure chamber communicating with the nozzle through a communication path, and an actuator for applying pressure to a liquid in the pressure chamber;

a first fluid flow path in which the liquid supplied to the pressure chamber of the ejector flows;

a second fluid flow path into which the liquid supplied from the first fluid flow path to the pressure chamber flows through the communication path;

a supply subtank connected to the ink supplied to the first fluid flow path, a circulation subtank connected to the ink discharged to the second fluid flow path, and a main tank connected to the supply subtank and to the circulation subtank respectively between the supply subtank and the circulation subtank;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path, the circulation unit being an up/down drive mechanism for moving the supply subtank and the circulation subtank up and down; and a liquid viscosity-increase prevention controller for changing the operation frequency of the liquid viscosity-increase prevention structure between when the liquid droplet is ejected from the nozzle, and when ejection of the liquid droplet is paused and no liquid droplet is being ejected from the nozzle.

18. A liquid droplet ejection head comprising:

an ejector including a nozzle for ejecting a liquid droplet, a pressure chamber communicating with the nozzle through a communication path, and an actuator for applying pressure to a liquid in the pressure chamber;

a cap member for preventing evaporation of a liquid by capping the nozzle;

a first fluid flow path in which the liquid supplied to the pressure chamber of the ejector flows;

a second fluid flow path into which the liquid supplied from the first fluid flow path to the pressure chamber flows through the communication path;

a supply subtank connected to the ink supplied to the first fluid flow path, a circulation subtank connected to the ink discharged to the second fluid flow path, and a main tank connected to the supply subtank and to the circulation subtank respectively between the supply subtank and the circulation subtank;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path, the circulation unit being an up/down drive mechanism for moving the supply subtank and the circulation subtank up and down; and a liquid viscosity-increase prevention controller for operating the liquid viscosity-increase prevention structure before the nozzle is uncapped from the cap member and ejects a liquid droplet.

19. An image forming apparatus having a liquid droplet ejection head, the liquid droplet ejection head comprises:

an ejector including a nozzle for ejecting a liquid droplet, a pressure chamber communicating with the nozzle through a communication path, and an actuator for applying pressure to a liquid in the pressure chamber, a cap member for preventing evaporation of a liquid by capping the nozzle;

a first fluid flow path in which the liquid supplied to the pressure chamber of the ejector flows;

a second fluid flow path into which the liquid supplied from the first fluid flow path to the pressure chamber flows through the communication path;

a supply subtank connected to the ink supplied to the first fluid flow path, a circulation subtank connected to the ink discharged to the second fluid flow path, and a main tank connected to the supply subtank and to the circulation subtank respectively between the supply subtank and the circulation subtank;

a liquid viscosity-increase prevention structure for preventing an increase of viscosity of the liquid in the ejector, the liquid viscosity-increase prevention structure being a circulation unit for circulating the liquid to the ejector through the first fluid flow path, and from the ejector through the second fluid flow path, the circulation unit being an up/down drive mechanism for moving the supply subtank and the circulation subtank up and down; and a liquid viscosity-increase prevention controller for operating the liquid viscosity-increase prevention structure before the nozzle is uncapped from the cap member and ejects a liquid droplet.

* * * * *